US005269478A

United States Patent [19]

Wakabayashi et al.

[11] Patent Number: 5,269,478

[45] Date of Patent: Dec. 14, 1993

[54] BOBBIN TRACE SYSTEM

[75] Inventors: Masahiro Wakabayashi; Yuji Todo, both of Kyoto; Tomonari Ikemoto, Uji, all of Japan

[73] Assignee: Murata Kikai Kabushiki Kaisha, Kyoto, Japan

[21] Appl. No.: 885,117

[22] Filed: May 18, 1992

[30] Foreign Application Priority Data

May 23, 1991 [JP] Japan ..... 3-46924[U]
Jun. 7, 1991 [JP] Japan ..... 3-136595

[51] Int. Cl.[5] ..... B65H 54/20; B65H 67/06

[52] U.S. Cl. ..... 242/35.50 A; 242/36; 57/264

[58] Field of Search ..... 242/35.5 A, 35.5 R, 242/36, 18 R; 57/264, 265, 281

[56] References Cited

U.S. PATENT DOCUMENTS 4,805,846 2/1989 Ueda et al. ..... 242/36
4,830,296 5/1989 Ueda et al. ..... 242/36
4,838,019 6/1989 Ueda ..... 242/35.5 A X
4,843,808 7/1989 Rüge et al. ..... 242/35.5 A X
5,003,762 4/1991 Scaglia ..... 242/35.5 A X
5,100,073 3/1992 Moehrke et al. ..... 242/36

*Primary Examiner*—Stanley N. Gilreath
*Attorney, Agent, or Firm*—Spensley Horn Jubas & Lubitz

[57] ABSTRACT

A bobbin trace system in which a bar code for distinguishing a bobbin is affixed on a tray on which the bobbin to be fed from the spindle on the fine spinning frame to the winder is inserted upright, the bar code is read by a bar code reader and at the same time the yarn characteristic of the bobbin of the code is detected, the yarn characteristic thus detected is transferred to the controller which controls the operation of the winder, and the controller reads the code of the tray to be fed to the winder and feeds the bobbin characteristic corresponding to this code back to the winder, thereby controlling the operation of the winder on the basis of the bobbin characteristic thus fed back.

7 Claims, 5 Drawing Sheets

BOBBIN TRACE SYSTEM

BACKGROUND OF THE INVENTION

1. Field of the Invention

The present invention relates to a bobbin trace system and, more particularly, to a bobbin trace system which enables winder control in accordance with the characteristic of a spinning bobbin coming from a fine spinning frame and is capable of detecting a related spindle from which the bobbin has come out. The present invention also relates to a winding system for an irregular bobbin.

2. Prior Art

Generally, in a conventional fine spinning frame, a spinning bobbin coming from the fine spinning frame which has a multitude of spindles is supplied to each spindle on a spun yarn winder. In this winder, spun yarn is unwound from the bobbin, forming a package. This winder is equipped with such a bobbin system that the bobbin discharged out of the fine spinning frame is inserted upright on the tray and carried to a specific position.

In the winder, the spun yarn being unwound from a bobbin is being wound at a high speed on each spindle. In this case, a winding tension of the spun yarn is controlled to a uniform value. That is, when the bobbin is in a fully wound state, the winding is done at a high speed, and with a gradual decrease in the remaining amount of yarn on the bobbin, for example to a 50-percent and to a 30-percent wound bobbin, the winding speed is controlled toward deceleration.

In the meantime, the spinning bobbins being discharged from the fine spinning frame and to be fed into the winder include 50-percent or 30-percent wound bobbins besides a number of full bobbins. If such an insufficiently wound bobbin is fed into the winder, it is impossible to control winding the yarn at a uniform tension.

OBJECT AND SUMMARY OF THE INVENTION

The present invention has been accomplished in an attempt to effectively solve the problems mentioned above. It is an object of the present invention to provide a bobbin trace system which enables the winding control of the winder in accordance with the configuration of bobbins to be fed into the winder, and also capable of finding out a fine-spinning spindle from which the incompletely wound bobbin came.

Another object of the present invention is to provide a winding system which can detect irregular bobbins such as 50-percent wound bobbin and can wind the irregular bobbin at appropriately controlled speed.

To fulfill the above-described object the present invention provides a bobbin trace system, wherein a bar code for recognizing each bobbin is affixed on a bottom of a tray on which a bobbin to be fed to a winder from each spindle coming from a fine spinning frame is inserted, the code being read; the characteristic of a related bobbin is detected and transferred to a controller which operates to control the winder; and subsequently the code of the tray to be fed to the winder is read to return the characteristic of the bobbin corresponding to the code from the controller to the winder, so that the operation of the winder will be controlled on the basis of the characteristic of the bobbin thus returned.

Since the characteristic of the bobbin thus discharged from the fine spinning frame is grasped prior to winding by the winder and winding control is performed on the basis of the characteristic, it is possible to conduct the winding control of a bobbin not fully wound, such as a 50-percent wound bobbin. Also, as the bobbins are distinguished from each other and the bobbin characteristic is grasped as previously stated, from which spindle on the fine spinning frame the bobbin has been discharged can be traced, thereby enabling the utilization of the trace system for quality control.

DETAILED DESCRIPTION OF PREFERRED EMBODIMENT

Hereinafter one embodiment of the bobbin trace system according to the present invention will be described in detail with reference to the accompanying drawings.

Figure 1:
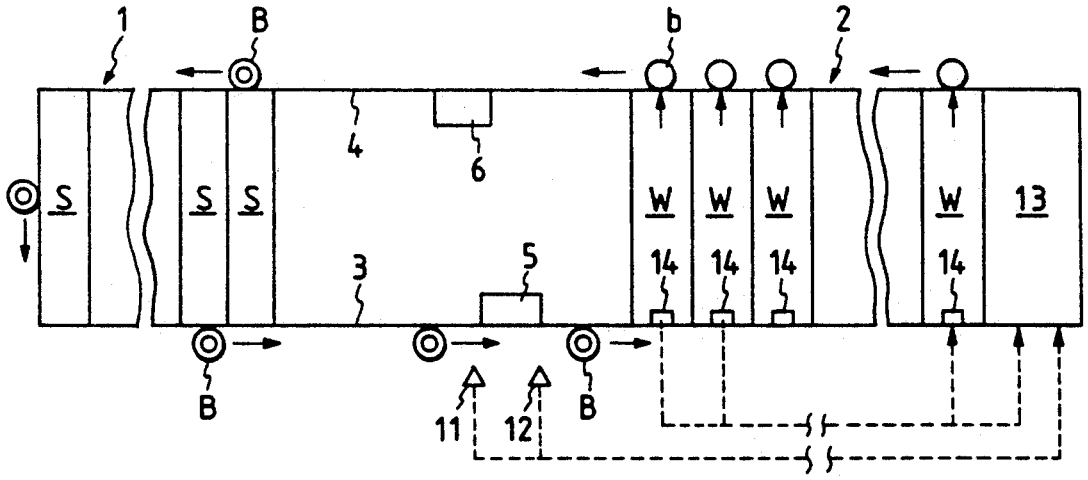
FIG. 1 is a plan view showing a bobbin trace system of the present invention.

FIG. 1 shows a first embodiment of the bobbin trace system according to the present invention. As shown in this drawing, there is formed a fine spinning winder connected between a fine spinning frame 1 comprising a multitude of spindles S for producing spinning bobbins B and a winder 2 including a number of spindles W for producing packages by taking up yarn from the bobbins B; by bobbin carrying lines 3 and 4, such as conveyors, which are connected between the fine spinning frame 1 and the winder 2, there is installed, on the entrance side of the winder, a yarn end finding apparatus 5 for finding out the yarn end from each of the bobbins B and for discharging the bobbins one by one to the winder 2 side. Installed on the exit side of the winder 2 is a bobbin residual yarn removing apparatus 6 for pulling residual yarn from a take-up tube of an empty bobbin b discharged from the winder 2.

The bobbin B that has been discharged from each spindle S of the fine spinning frame 1 is inserted upright on the tray T and supplied to the winder 2. The tray T consists of a peg 7 on which the bobbin B is inserted, and a disk-like base plate 8.

Figure 3:
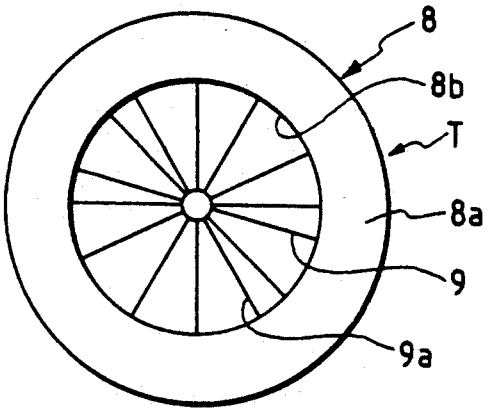
FIG. 3 is a view showing a bar code.

Particularly the base plate 8 of this tray T has a recess 8*b* *formed* in the bottom 8*a* thereof. In this recess is affixed a round sticker of bar code 9 special to each tray as shown in FIG. 3. This bar code sticker 9 forms a distinguishing mark for distinguishing each tray T. In the drawing the bar code sticker 9 has a round bar code 9*a* consisting of radially arranged bars.

Figure 2:
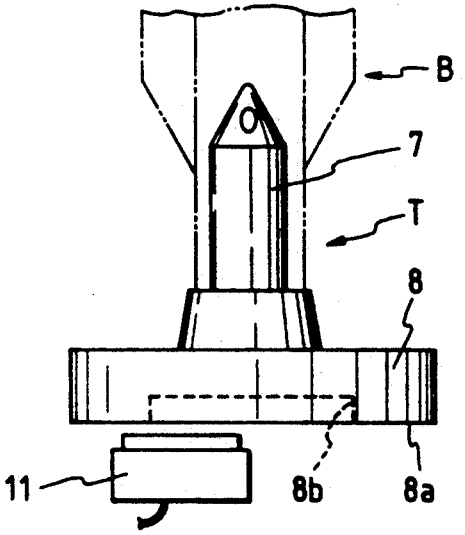
FIG. 2 is a side view showing a tray.

The bar code sticker 9 thus formed is read by a bar code reader 11 provided at the entrance side of the yarn end finding apparatus 5. This bar code reader 11 is installed, upwardly directed, immediately below the tray T as shown in FIG. 2. The bar code 9*a* is designed to be read as the tray T turns above the bar code reader 11. This bar code 9a may be made in a form of concentrical circular bar code. In this case the tray T is not required to rotate.

On the discharge side of the yarn end finding apparatus 5 is installed a sensor 12 for detecting the bobbin characteristic, that is, "to what percent the bobbin has been wound", of the bobbin B inserted upright on the tray and being carried as shown in FIG. 1. This sensor 12 is made of for example a plurality of feelers equally spaced in the axial direction of the bobbin B though not illustrated.

Detected signals from these bar code readers 11 and sensors 12 are sent to a controller 13 which controls the operation of the winder 2. To this controller 13 is transferred the bobbin characteristic corresponding to a code read by the bar code reader 11. This controller 13 is designed to receive information concerning the operation of each spindle W of the winder 2. That is, the controller 13 is designed to be inputted with the winding amount of package for each spindle W of the winder 2, completion of feed of yarn from the bobbin, number of times of yarn breakage, and a signal requiring a new full bobbin B for doffing. For each spindle W of the winder 2 are mounted a length detecting apparatus for detecting the winding amount of package, a feeler for detecting the end of feed of yarn from the bobbin, a slub catcher for detecting yarn breakage, a splicer for knotting, a bobbin doffing apparatus for changing bobbins, and a controller for decreasing winding speed.

At the spindle W entrance of the winder 2 there is installed a bar code reader 14 for reading the bar code 9a attached on the tray T that has entered the winder 2. This bar code reader 14, like the bar code reader 11 installed on the discharge side of the yarn end finding apparatus 5, reads the bar code 9a on the tray T that has entered the winder 2 and transfers the code to the controller 13. Bobbin characteristic of the bobbin is transferred from the controller 13 to the winder 2.

Subsequently, as shown in FIG. 1, first the bobbins B simultaneously doffed on the fine spinning frame 1 are discharged out in the order of spindle arrangement and at the same time are inserted upright on the trays T with the bar code sticker 9 affixed, then being supplied to the yarn end finding apparatus 5. The bobbins B with their yarn end led out are discharge out in succession into the winder 2.

The bar code 9a on the tray T is read by the bar code reader 11 when the bobbin B passes through the yarn end finding apparatus 5, and at the same time the characteristic of the bobbin B specified by the bar code thus read is detected by the sensor 12, being transferred to the controller 13. That is, a fine spinning spindle S from which the bobbin B has been removed will be specified by the bar code 9a, and to the controller 13 are transferred, by each code number (tray number), the information on "to what percent the bobbin has been wound" and "the location of a spindle from which the bobbin has come".

On the other hand, each spindle W of the winder 2 is provided with the bar code reader 14, which reads the bar code 9a attached on the tray T received by the spindle W, the code thus read being transferred to the controller 13. The controller 13 sends back to the winder W the bobbin characteristic information on "to what percent the bobbin has been wound" corresponding to the code already transferred, every time the code that has been read at each spindle of the winder 2 is transferred. The speed of rotation of this spindle W is controlled toward deceleration in accordance with the information returned.

For example, when a 30-percent wound bobbin B has been fed to a specific spindle W on the winder 2 side, the bobbin characteristic that the bobbin is a 30-percent wound bobbin has already been transferred to the controller 13 from the bar code reader 11 and the sensor 12. Therefore, on the basis of this bobbin characteristic of "30-percent wound bobbin" fed from the controller 13, the spindle W speed will be decelerated to take up the yarn from the 30-percent wound bobbin at a uniform tension. Since the bobbin characteristic is known when taking up the yarn from the bobbin, it is possible to decelerate, by each bobbin, the spindle W speed corresponding to the bobbin characteristic.

Furthermore, the controller 13 is fed with yarn breakage at each spindle W on the winder 2, and stores the number of yarn breakage at the winder 2, by each bobbin on the basis of the information on the "location of a spindle from which the bobbin has come". That is, the spinning bobbins B used for making packages will become definite for each of the packages thus formed on the winder 2. Consequently, it is possible to trace back to "the spindle from which the bobbin subjected to frequent yarn breakage has come". The bobbin trace system, therefore, is usable for yarn quality control. Furthermore, as the bar code sticker 9 is provided on the bottom 8a of the tray T, the reading of the bar code 9a will not be disturbed with flying yarn waste and besides it will become possible to trace back to a spindle simply by affixing the bar code sticker 9 on the tray T, thus enabling voluminous production of packages.

Figure 4:
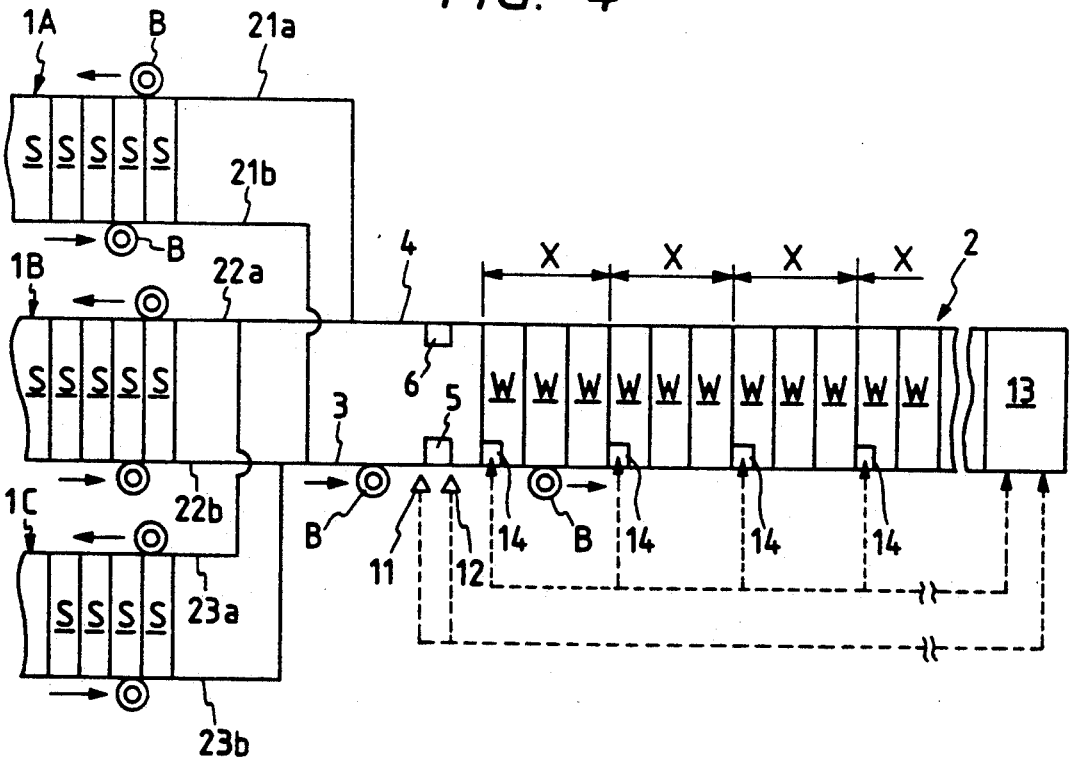
FIG. 4 is a plan view showing another embodiment of the bobbin trace system.

FIG. 4 shows a second embodiment, in which a bobbin trace system is adopted for a spinning winder 2 which links three fine spinning frames 1A, 1B, 1C to a single winder.

That is, there are installed three fine spinning frames 1A, 1B and 1C, which are connected to the conveyor line 3 on the entrance side of the winder 2 and to the conveyor line 4 on the exit side through conveyor lines 21a, 21b, 22a, 22b, 23a and 23b. At the entrance side of the winder 2 is installed the yarn end finding apparatus 5 which leads out the yarn end of the bobbin B and discharges the bobbin B at a predetermined timing. At the entrance side is installed the bar code reader 11, and at the exit side is mounted the sensor 12 for detecting the bobbin characteristic in the similarly manner as the embodiment described above. The winder 2 is equipped with the controller 13 as in the case of the above-described embodiment and, and the bar code reader 14 is mounted, one for each span X involving a specific plurality of spindles W, on the entrance side for reading the bar code 9a attached on the tray T which moves into the winder 2.

As the bobbins B are discharged out of the yarn end finding apparatus 5 every predetermined time of movement (e.g., 5 seconds) through one span X, the bar code 9a of the related tray T of the bobbin B is read by the bar code reader 14 corresponding to the specific span X. The code thus read is transferred to the controller 13. The controller 13 sends back the bobbin characteristic, that is, "to what percent the bobbin has been wound", corresponding to the code already fed from the bar code reader 11 and the sensor 12, to the spindle W waiting for the bobbin B. This spindle W will be decelerated on the basis of the bobbin characteristic sent back from the controller 13.

That is, the controller 13 receives, at a predetermined timing, a code read by, and transferred from, the bar code reader 14 which reads the bar code on the tray T of the bobbin B discharged from the fine spinning frame, thereby distinguishing the span X to which the bobbin B has been fed. Then the controller 13 feeds, back to the spindle W, the bobbin characteristic of the code read by the bar code reader 14 in the span X involving the spindle W to which the bobbin B has been fed.

Since the bobbins B are discharged out at a predetermined timing, the controller 13 using a small number of bar code readers 14 is able to perform the tracing of the bobbin B and the deceleration of the spindle W.

According to the present invention, the bobbin characteristic is grasped prior to unwinding at the winder and the winding speed is controlled on the basis of the bobbin characteristic, and therefore the unwinding of an insufficiently wound bobbin can be controlled. Furthermore, since the tray mounted with the bobbin B is distinguished to know the bobbin characteristic, it is possible to trace back to a spindle from which the insufficiently wound bobbin has come, and to utilize the bobbin trace system for quality control.

A third embodiment of the automatic winder according to the present invention supplies bobbins mounted on trays to a number of winding units parallelly arranged, through a feed conveyor. At the entrance of the feed conveyor there are installed a bobbin shape detecting device and a writing device for writing a detected information on the tray, and a reading device, in each winding unit, for reading information written on the tray.

An irregular bobbin is concentratedly detected by means of the bobbin shape detecting device mounted at the entrance of the feed conveyor, and an information thus obtained on the bobbin shape is written on the tray by the writing device. At the winding unit for each spindle, the information on the bobbin shape is read by the reading device, and the irregular bobbin is rotated at an appropriate speed in accordance with a winding speed pattern formed in accordance with the information thus obtained.

Figure 5:
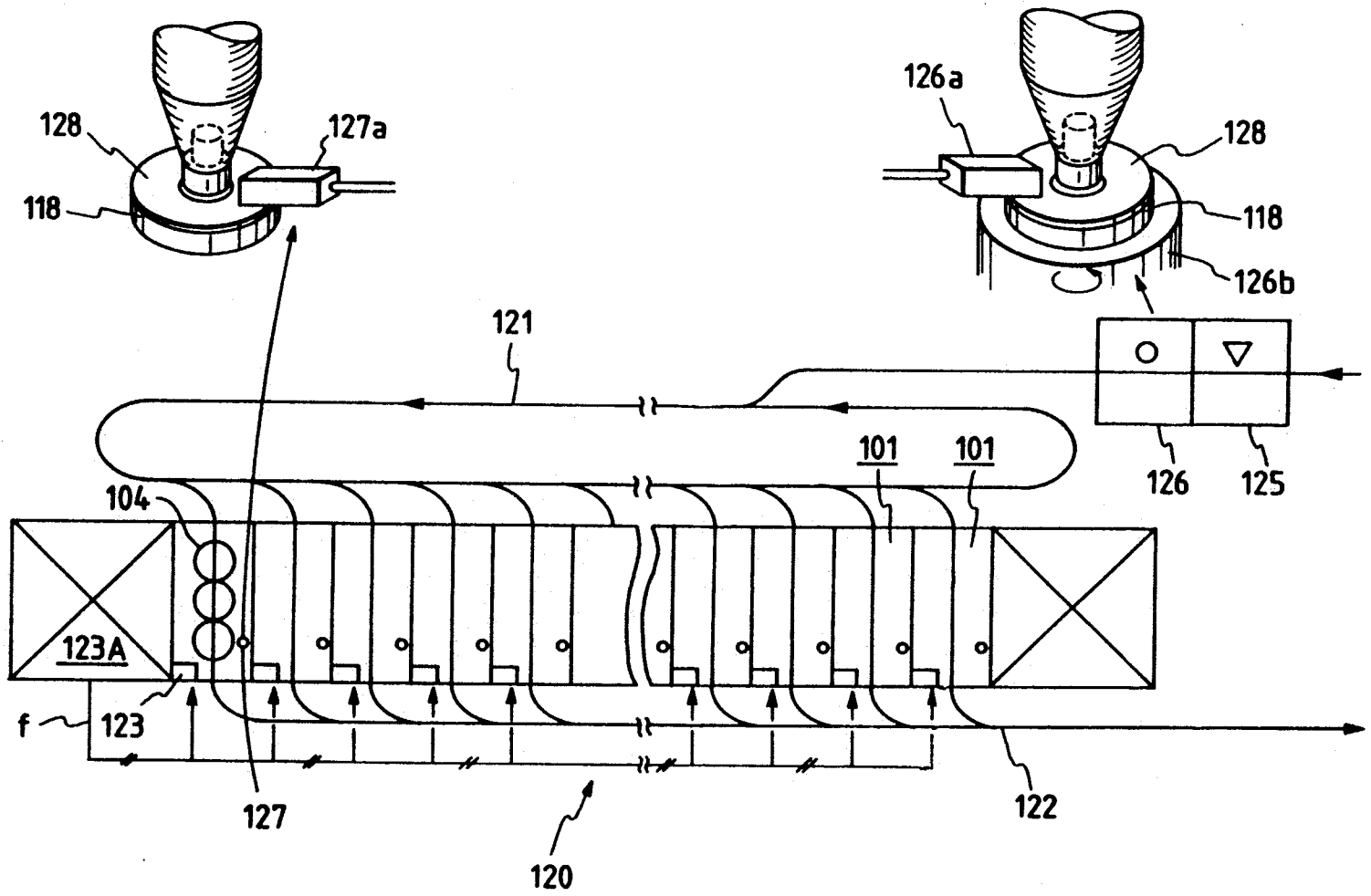
FIG. 5 is a general view of an embodiment of an irregular bobbin winder of the present invention.

Hereinafter the third embodiment of the automatic winder according to the present invention will be explained with reference to the accompanying drawings. FIG. 5 is a general view showing the automatic winder using the irregular bobbin winder of the present invention.

In this drawing, the automatic winder 120 is equipped with a bobbin shape detecting device 125 and a writing device 126 at the entrance of a bobbin feed conveyor 121, and each winding unit is provided with a reading device 127. On the circumferential surface of the tray 118 is affixed a magnetic sheet 128.

The bobbin shape detecting device 125 is a shape sensor, which is mounted at the entrance of the feed conveyor 121 to concentratedly detect the shape of bobbins. Since one bobbin shape detecting device 125 is sufficient for the automatic winder 120, a high-precision device is usable for more accurate measurements of 40-, 50- and 60-percent wound bobbins. Information from this bobbin shape detecting device 125 is written on a magnetic sheet on a tray 118 by means of the writing device 126.

As shown in the drawing, the writing device 126 includes a write head **126*a* and a turntable 126*b*, usually being formed integral with the bobbin shape detecting device 125. The write head 126*a* operates to write information radially arranged on the magnetic sheet 128, during at least one turn of the turntable 126. The radial arrangement of information allows reading the information from a part of the circumferential surface of the magnetic sheet 128 even when the tray 118 rotates freely. The magnetic sheet may be affixed on the side surface in place of the circumferential surface of the tray 118**, for writing information in vertical arrangement.

The reading device 127 has a read head **127*a* protruding toward the tray 118 located at the winding position as illustrated, for reading radially arranged information on the magnetic sheet 128 on the tray 118. It is possible to read the information at any optional position of the magnetic sheet 128. This magnetic sheet contains information on the shape of a bobbin. This information is inputted to the controller 123 to control, for example, the winding speed. In FIG. 5, reference character 104 designates a bobbin, reference character 122 designates an empty bobbin discharging conveyor, reference character 123A designates a whole control apparatus and reference character f** designates a communication line.

Figure 6A:
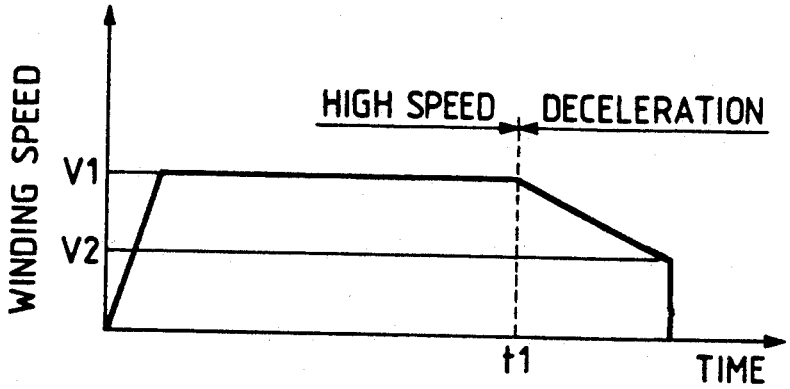
FIG. 6*a* is a graph showing an example of a winding pattern of a normal bobbin.
Figure 6B:
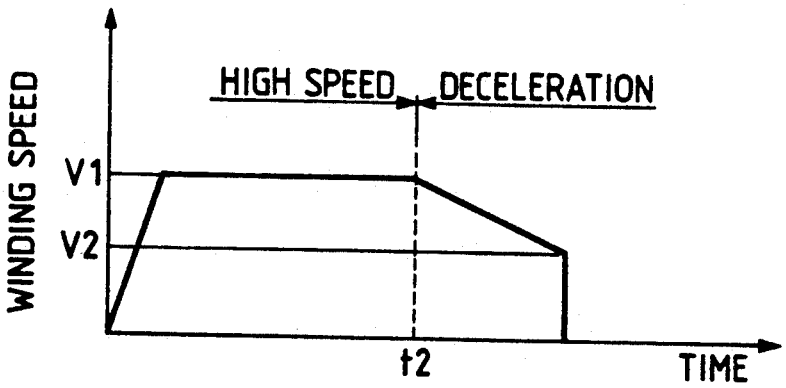
FIG. 6*b* is a graph showing an example of a winding pattern of a defective bobbin.

Next, the operation of the irregular bobbin winder will be explained. For example, an irregularly 50-percent wound bobbin, if present, will be detected by the bobbin shape detecting device 125, and an information on the 50-percent wound bobbin will be written in a radial arrangement on nearly the whole circumferential surface of the magnetic sheet. The tray 118 having the data on the 50-percent wound bobbin is carried on the bobbin feed conveyor 121 into a specific position in the winding unit 101. When the tray 118 reaches the winding position, the read head **127*a* of the reading device 127 reads the information in radially arrangement from the magnetic sheet 128, distinguishing the 50-percent wound bobbin. Then, the controller 123, as shown in FIG. 6*b*, gives an instruction about the winding speed deceleration timing t2, thereby preventing occurrence of yarn breakage and bobbin slough-off. FIG. 6*a* shows a normal full bobbin deceleration timing. The winding unit of each spindle is sufficient if provided with a simple read device 127, which can lower a cost as compared with the spindle using a sensor for sensing the bobbin shape. Also it is possible to facilitate type-wise operation by increasing data to be written in the magnetic sheet 128 of the tray 118**.

The magnetic sheet affixed on the tray has been explained hereinabove; in this case, the write device may be such a device that attaches a specific ID tag, which will be read out by the read device.

In the irregular bobbin winder of the present invention the bobbin shape detecting device concentratedly detects an irregular bobbin and writes information on the bobbin shape on the tray by means of the write device. This information on the bobbin shape on the tray is read by the read device on the winding unit of each spindle, enabling taking up an irregular bobbin in accordance with an appropriate take-up speed pattern. It is, therefore, unnecessary to install a costly sensor at each spindle for measuring the shape of an irregularly wound bobbin, thereby enabling the reduction of cost of the automatic winder.

In the winding unit explained above, all the spindles are designed to wind irregularly wound bobbins such as 50-percent wound bobbins; therefore it is necessary to provide each winding unit of all the spindles with a sensor for sensing the bobbin shape or for detecting an identification mark of a tray. This sensor, being designed to detect unspecified shapes of wound bobbins, is expensive. The winding unit, therefore, has the problem that providing every winding unit of all of the spindles with the sensor will largely increase the cost of the automatic winder.

This embodiment of present invention has been accomplished in an attempt to solve the problem mentioned above and has as its object the provision of an irregular bobbin winding unit which is capable of winding an irregularly wound bobbin by a specific spindle as well as winding normal bobbins when there exist few irregular bobbins.

The irregular bobbin winding unit of this embodiment of the present invention is a specific spindle comprising a winding unit having one or more waiting positions in addition to a winding position. An irregular bobbin feeding device is used to feed the irregularly wound bobbin to this specific spindle. Further the irregular bobbin winding unit which winds the irregular bobbin by changing the winding speed pattern or the winding speed is equipped with a bobbin sensor in the waiting position and a controller which operates the irregular bobbin feeding device to feed a normal bobbin when no irregular bobbin has been detected by the sensor.

An irregularly wound bobbin is fed to the irregular bobbin winding unit which is a specific spindle, through the irregular bobbin feeding device; the yarn on this irregularly wound bobbin is taken up by this specific spindle at the winding speed pattern or the winding speed changed which has been changed, while other spindles take up yarn from normal bobbins at a preset winding speed pattern. When the yarn being supplied to the irregular bobbin winding unit from the irregular bobbin remains little, the sensor in the waiting position detects it, and the controller actuates the bobbin feeding device to feed normal bobbins, thus efficiently operating the irregular bobbin winding unit.

Figure 7:
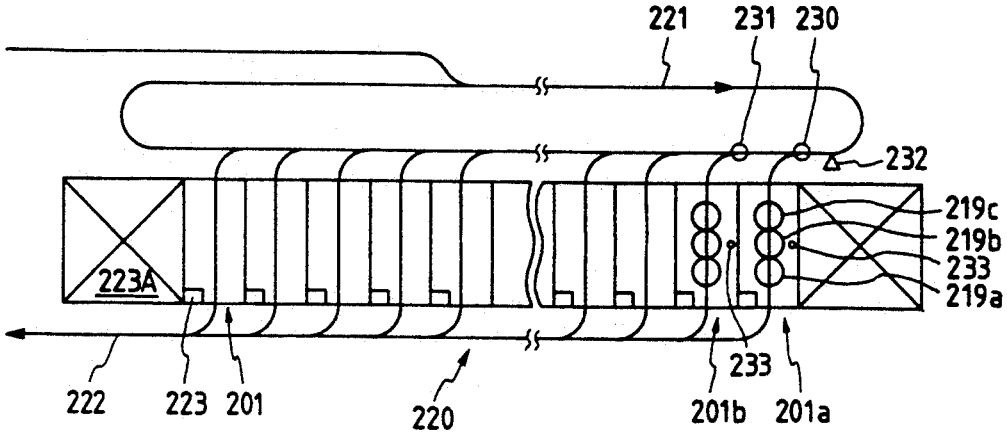
FIG. 7 is a general view of another embodiment of an automatic winder of an irregular bobbin winding unit according to the present invention.

Hereinafter an exemplary embodiment of an irregular bobbin winding unit according to the present invention will be explained with reference to the accompanying drawings. FIG. 7 is a general arrangement plan of an automatic winder used for the irregular bobbin winding unit of the present invention; and FIG. 8 is a perspective view showing a major portion of the irregular bobbin winding unit.

In the automatic winder 220 in FIG. 7, two spindles 201*a* and 201*b* are the irregular bobbin winding units as the specific spindles. A numeral 201 refers to a common winding unit as a general spindle. Mounted at the entrance of each of the specific spindles 201*a* and 201*b* are feeding devices 230 and 231. These feeding devices 230 and 231 incorporate a mechanical interlock so as to operate in case no bobbin is present in the second waiting position 219*c*. Before the specific spindle 201*a* of the bobbin feed conveyor 221, a first sensor 232 is installed for detecting an irregularly wound bobbin. The feeding devices 230 and 231 are operated by this first sensor 232. Further, in the first waiting position 219*b* of each of the specific spindles 201*a* and 201*b* is installed a second sensor 233 for detecting the presence or absence of a bobbin.

Figure 8:
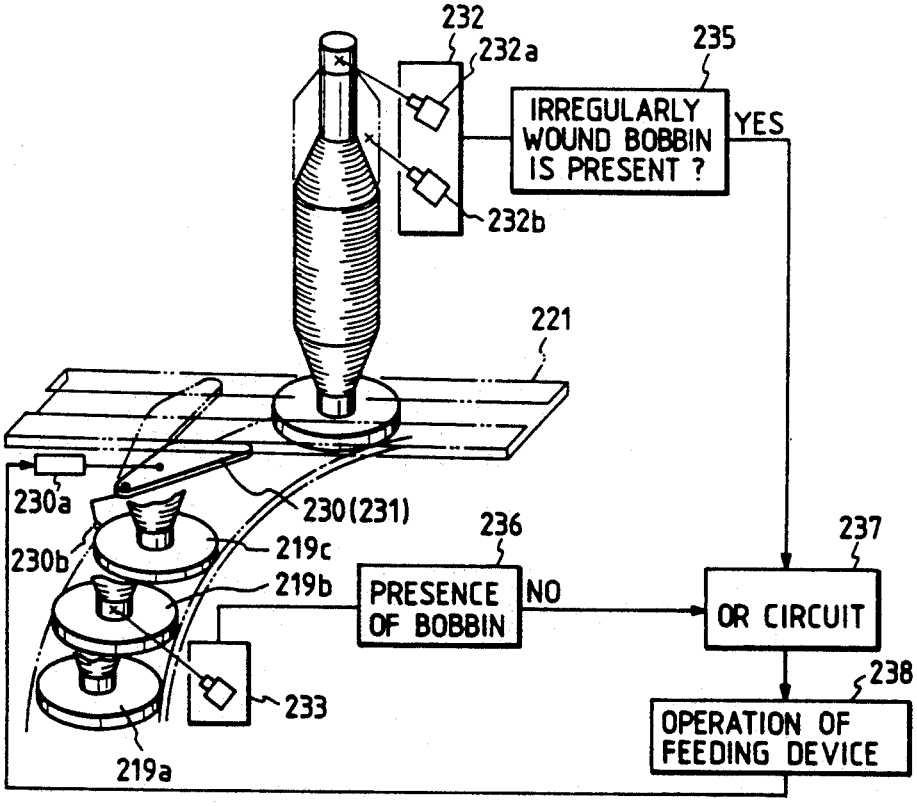
FIG. 8 is a perspective view of a major portion of the irregular bobbin winding unit.

In FIG. 8, the feeding device 230 is a rotatable plate and is operated by a solenoid 230*a* in the position indicated by an alternate long and two short dashes line. When an arm 230*b* comes in contact with a tray waiting in the second waiting position 219*c*, the feeding device 230 is operated by the mechanical interlock incorporated for feeding a bobbin when no bobbin is present in the second waiting position 219*c*. The first sensor 232 has a bobbin sensor 232*a* and a yarn layer sensor 232*b*, judging a normal bobbin when both the sensors 232*a* and 232*b* are on, and an irregular bobbin when the sensor 232*a* is on while the sensor 232*b* is off. The second sensor 233 consists of a single bobbin sensor. A "YES" signal indicating the presence of an irregularly wound bobbin in a block 235 and a "NO" signal indicating the absence of a bobbin in the first waiting position of a block 236 are both inputted to an OR circuit of a block 237, and the feeding device is operated in a block 238. In FIGS. 7 and 8, reference character 219*a* designates a winding-up position, reference character 222 designates an empty bobbin discharging conveyor, reference character 223 designates a control device for each spindle and reference character 223A designates a whole control apparatus.

Next, the operation of the irregular bobbin winding unit shown in FIGS. 7 and 8 will be explained. In FIG. 7, the first sensor 232 at the entrance of the bobbin feed conveyor 221 detects an irregularly wound bobbin, operating the feeding devices 230 and 231. If, in this case, there exists no bobbin in the second waiting position 219*c* of the specific spindle 201*a*, the irregular bobbin will be fed to the specific spindle 201*a*; when a bobbin is present in the second waiting position 219*c* of the specific spindle 201*a*, the irregularly wound bobbin will be fed to the specific spindle 201*b*. Usually, since the irregular winding of bobbins occurs at a rate of several percent, two specific spindles 201*a* and 201*b* are sufficient in the case of a 50-spindle automatic winder. The specific spindles 201*a* and 201*b* are fixed at a speed pattern for decelerating at a high timing t2 of FIG. 6*b*, thereby preventing yarn breakage and slough-off at the end of unwinding of the irregular bobbin.

In FIG. 8, when the second sensor 233 detects no bobbin in the first waiting position 219*b* of either specific spindle 201*a* or 201*b*, this signifies that the rate of occurrence of irregular winding is low. In this case, bobbin feeding to the specific spindles 201*a* and 201*b* will cease, resulting in a lowered operation efficiency of the whole automatic winder. To prevent this, the second sensor 233 detects the absence of a bobbin in the first waiting position 219*b*, and actuates the feeding device 230 through the OR circuit 237 of the controller to feed normal bobbins, thereby efficiently operating the specific spindles 201*a* and 201*b*.

In the above-described embodiment of the specific spindles, the irregularly wound bobbin yarn is taken up at a changed winding speed pattern for decreasing the timing time to change the winding speed from the high speed v1 to the low speed v2 shown in FIG. 6*b*. However, winding at the specific spindles can also be done by changing the winding speed itself so as to take up the irregularly wound bobbin yarn at a uniform low speed v2.

The irregular bobbin winding unit of this embodiment of the present invention has been designed such that an irregularly wound bobbin is fed through the feeding device, the irregularly wound bobbin yarn is taken up at a changed winding speed pattern or a changed winding speed, a small number of irregular bobbins to be fed are detected by the sensor for the waiting position, and then the controller operates the feeding device, by which normal bobbins are fed, thus efficiently operating the irregular bobbin winding unit.

Therefore all winding units other than the irregular bobbin winding unit may be operated at a uniform winding speed pattern, thereby enabling reducing the cost of the automatic winder without lowering the operation efficiency of the irregular bobbin winding unit even when there occurs little irregular winding of bobbins.

What is claimed is:

1. In a system wherein bobbins are transported on trays between a spinning frame and a winder having a plurality of winding spindles, a bobbin tracing system comprising:

controller means for controlling the plurality of winding spindles, tray identification information associated with a tray for individually identifying the tray, first reading means for reading the tray identification information on a try discharged from the spinning frame and for communicating the tray identification information to the controller means, sensing means for sensing yarn characteristics of a bobbin on the tray discharged from the spinning frame and for communicating the yarn characteristics to the controller means, second reading means associated with a winding spindle for reading the tray identification information on a tray introduced to the winding spindle and for communicating the tray identification information to the controller means, the controller means being responsive to the second reading means, whereby the controller means controls the operation of the winding spindle in accordance with the tray identification information received from the first reading means and the yarn characteristics received from the sensing means.

2. The system of claim 1, wherein the spinning frame comprises a plurality of spinning spindles, the tray identification information comprises information identifying the spinning spindle from which the bobbin on the tray has been discharged, wherein the sensing means comprises means for determining the percent of the bobbin on the tray that has been wound, and wherein the controller means comprises means for controlling the speed of rotation of each of the plurality of winding spindles.

3. The system of claim 1, comprising a yarn end finding device disposed between the spinning frame and the winder, wherein the second reading means is associated with a predetermined plurality of winding spindles, and wherein bobbins are discharged from the yarn end finding device at a predetermined interval.

4. The system of claim 1, wherein each bobbin on a tray defines a shape, wherein the winder comprises a feed conveyor having an entrance, and further comprising:

detecting means located near the entrance of the feed conveyor for detecting the shape of the bobbin, writing means located near the entrance of the feed conveyor and in communication with the detecting means for writing onto a tray information identifying the shape of the bobbin on the tray, and reading means associated with at least one of the winding spindles for reading the information identifying the shape of the bobbin on the tray.

5. The system of claim 1, wherein the winder comprises:

an irregular bobbin winding spindle defining a winding position and at least one waiting position, a bobbin feeding unit for feeding an irregular bobbin or a normal bobbin to the irregular bobbin winding spindle, means for controlling at least one of a winding speed pattern or a winding speed of the irregular bobbin winding spindle to unwind a bobbin, wherein the irregular bobbin winding spindle comprises:

a bobbin sensor mounted adjacent the at least one waiting position, and a controller for operating the bobbin feeding unit to feed a normal bobbin to the spindle when no irregular bobbin is sensed by the bobbin sensor.

6. In an automatic winder having a feed conveyor for supplying bobbins on associated trays to a plurality of winding units arranged substantially in parallel, each of the bobbins defining a shape, an irregular bobbin winder comprising:

detecting means for detecting the shape of a bobbin, writing means for writing information identifying the detected shape of the bobbin onto the tray associated with the bobbin, the feed conveyor defining an entrance and the detecting means and the writing means being located adjacent the entrance of the feed conveyor, and reading means for reading the information identifying the detected shape of the bobbin from the tray associated with the bobbin.

7. An irregular bobbin winding unit comprising:

an irregular bobbin winding spindle defining a winding position and at least one waiting position, a bobbin feeding unit for feeding an irregular bobbin or a normal bobbin to the irregular bobbin winding spindle, means for controlling at least one of a winding speed pattern or a winding speed of the irregular bobbin winding spindle to unwind a bobbin, wherein the irregular bobbin winding spindle comprises:

a bobbin sensor mounted adjacent the at least one waiting position, and a controller for operating the bobbin feeding unit to feed a normal bobbin to the spindle when no irregular bobbin is sensed by the bobbin sensor.

* * * * *